US006234893B1

(12) United States Patent
Meredith

(10) Patent No.: US 6,234,893 B1
(45) Date of Patent: May 22, 2001

(54) VENT DEVICE FOR USE WITH MEDIUM FOR ALTERING A CONDITION OF AIR ENTERING AN ENVIRONMENT

(76) Inventor: Jerry R. Meredith, 5121 Camelia Rd., Knoxville, TN (US) 37912

( * ) Notice: Subject to any disclaimer, the term of this patent is extended or adjusted under 35 U.S.C. 154(b) by 0 days.

(21) Appl. No.: 09/547,899

(22) Filed: Jul. 1, 2000

(51) Int. Cl.[7] ..... F24F 7/00
(52) U.S. Cl. ..... 454/289; 454/291
(58) Field of Search ..... 454/291, 289, 454/284, 337, 328

(56) References Cited

U.S. PATENT DOCUMENTS

| | | | | |
|---|---|---|---|---|
| 2,575,499 | * | 11/1951 | Manow | 454/309 |
| 3,930,797 | * | 1/1976 | Gertz | 21/74 R |
| 5,141,707 | * | 8/1992 | Brite | 422/124 |
| 5,176,570 | * | 1/1993 | Liedl | 454/309 |
| 5,616,076 | * | 4/1997 | Higgins | 454/367 |
| 5,674,124 | * | 10/1997 | Davis | 454/290 |
| 5,792,230 | * | 8/1998 | Moore et al. | 55/493 |
| 5,947,815 | * | 9/1999 | Danforth | 454/289 |

* cited by examiner

*Primary Examiner*—Denise L. Ferensic
*Assistant Examiner*—Derek S. Boles

(57) ABSTRACT

A vent device (10) for communicating air from the duct of an air supply system into an environment, such as a room of a building, includes a body (12) having a passageway (18) therethrough for receiving air from the air supply system, with the body (12) defining a first opening (20) for placing the passageway in fluid communication with the air supply system. Also included is a filter housing defining a filter slot (46), the filter housing having an inner wall (50) provided with a plurality of first vent openings (54) for being selectively placed in communication with the passageway of the body. Further, the filter housing has an outer wall provided with a plurality of second vent openings communicating with the filter slot and the room in the building so as to communicate air from the filter slot into the room. The vent device also includes a filter (58) for being removably received in the filter slot of the filter housing, the filter defining an enclosure (60) having a cavity (62) which houses a filter material (63). The enclosure (60) has an inner and outer walls (64, 66), with the inner wall (64) being provided with a plurality of third vent openings (68) and the outer wall (66) being providing with a plurality of fourth vent openings (70) which register with the third vent openings (68) to provide air flow through the filter (58).

16 Claims, 17 Drawing Sheets

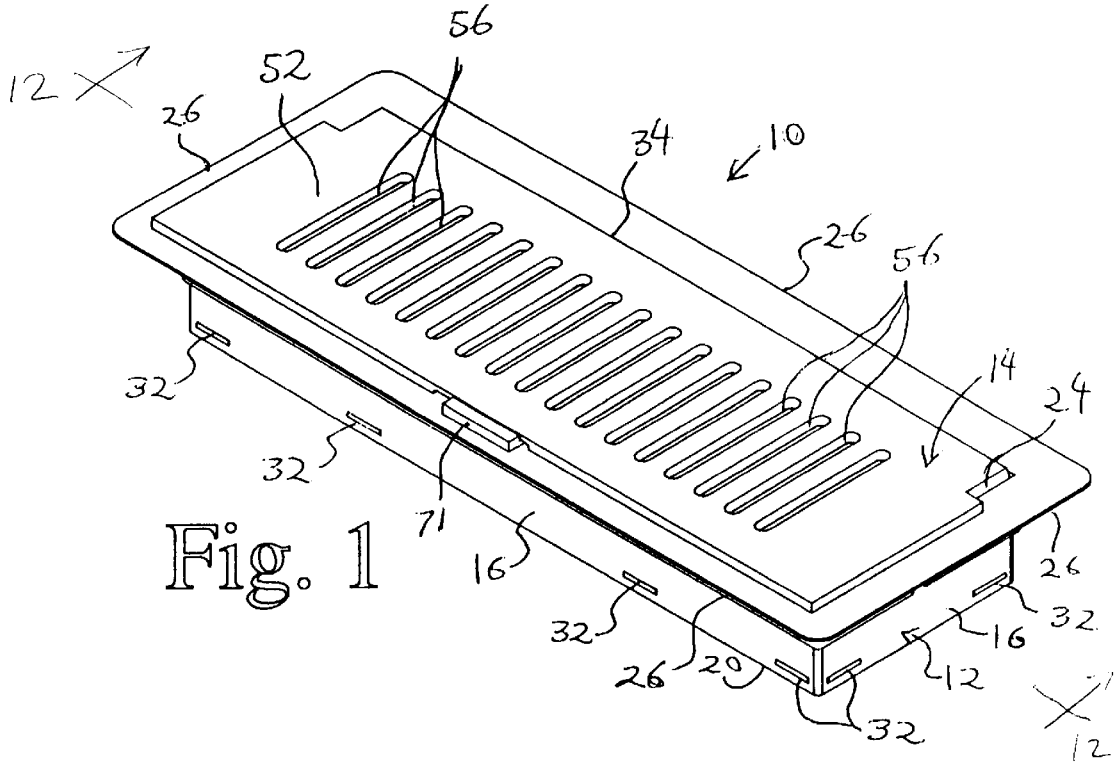
Fig. 1
Fig. 2
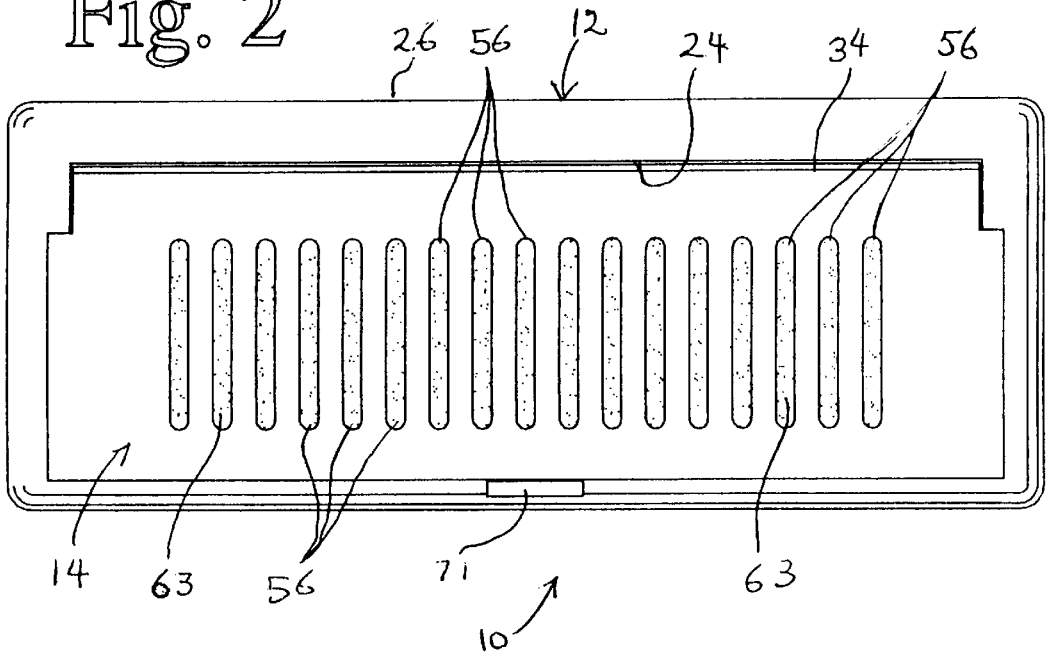

10
12
14
16
18
20
26
32
34
36
40
48
50
54
63

10
12
14
16
26
32
36
52
71

10
12
14
16
26
32
34
36
52

VENT DEVICE FOR USE WITH MEDIUM FOR ALTERING A CONDITION OF AIR ENTERING AN ENVIRONMENT

BACKGROUND OF THE INVENTION

This invention relates generally to the means and methods for controlling conditions of the air of an environment and relates, more particularly, to the vents through which air is moved by an air handling system into an environment within which the conditions of the air are desired to be controlled.

Vents, also known as registers, for communicating, or conducting, air from the duct or conduit of an air delivery system into an environment, such as a room of a building, are well known in the art. Such vents commonly include a body having a passageway therethrough for receiving air from the duct or conduit and defining a plurality of vent openings which direct air flow into the environment. It is also common for such vents to include a closure mechanism, such as a louver mechanism, which permits the volume of air communicated into the environment by way of the vent openings to be selectively controlled. It would be desirable to provide such a vent which is adapted to support condition-altering mediums, such as a filter, through which the air is permitted to pass in order to condition the air in a desired manner before the air enters the environment.

Accordingly, it would be desirable to provide a new and improved vent device through which air is discharged into an environment by an air-delivery system wherein the device is adapted to support a condition-altering medium through which the air is permitted to pass as the air enters the environment.

Another object of the present invention is to provide such a vent device wherein a condition-altering medium can be readily installed within or removed from the device.

Still another embodiment of the present invention is to provide such a vent device wherein a condition-altering medium positioned therein can be used to alter the flow of air permitted to exit the vent device.

Yet another embodiment of the present invention is to provide such a vent device which is well-suited for holding a filter for filtering unwanted materials, such as dust and pollen, from the air as the air enters the environment.

A further embodiment of the present invention is to provide such a vent device which is uncomplicated in construction and effective in operation.

SUMMARY OF THE INVENTION

This invention resides in a vent device for communicating air from an air supply system into an environment.

The vent device includes a body having a passageway through which air is permitted to flow from an air supply system and into an environment, and the passageway includes an opening. In addition, the device includes a housing having a cavity within which a condition-altering medium is positionable and having vent openings which permit the flow of air through the cavity so that a condition-altering medium positioned within the cavity can alter a condition of the air which flows through the cavity. The housing is attached to the body for movement relative thereto between a closed condition at which the housing is positioned within the opening of the passageway of the body so that air which flows through the passageway from the air supply system is conducted through the cavity of the housing means and an open condition at which access is provided to the cavity of the housing for removal of a condition-altering medium contained in the cavity or for placement of a condition-altering medium into the cavity.

BRIEF DESCRIPTION OF THE DRAWINGS

FIG. 1 is a perspective view of a vent device within which features of the present invention are incorporated.

FIG. 2 is a top plan view of the vent device of FIG. 1.

DETAILED DESCRIPTION OF THE ILLUSTRATED EMBODIMENTS

Figure 3:
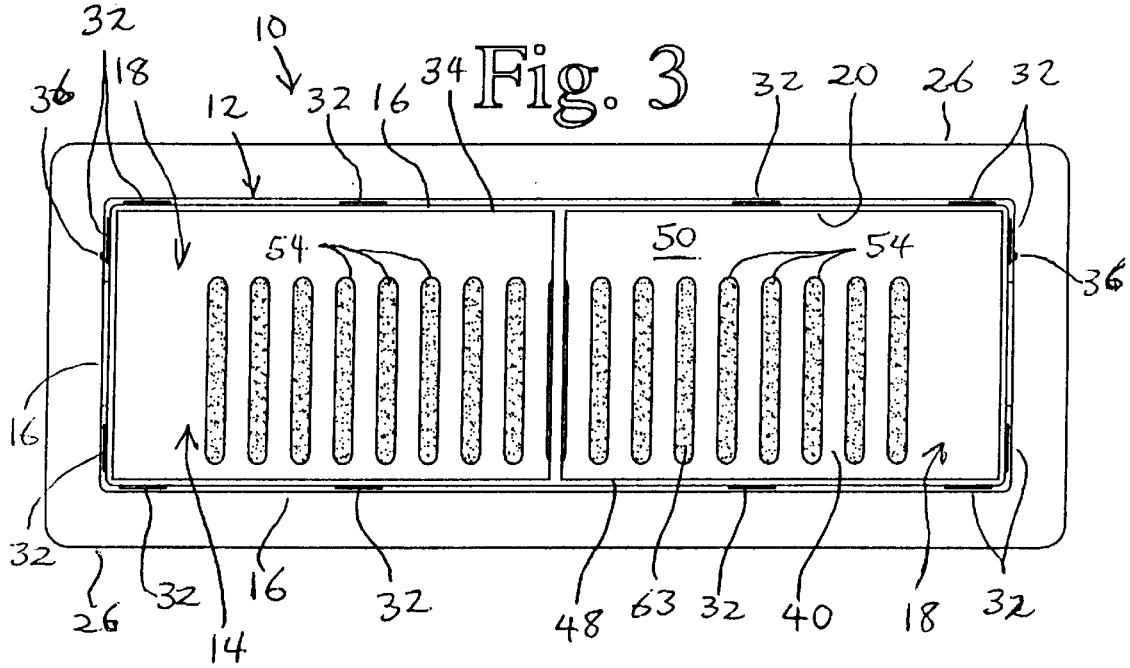
FIG. 3 is a bottom plan view of the vent device of FIG. 1.
Figure 4:
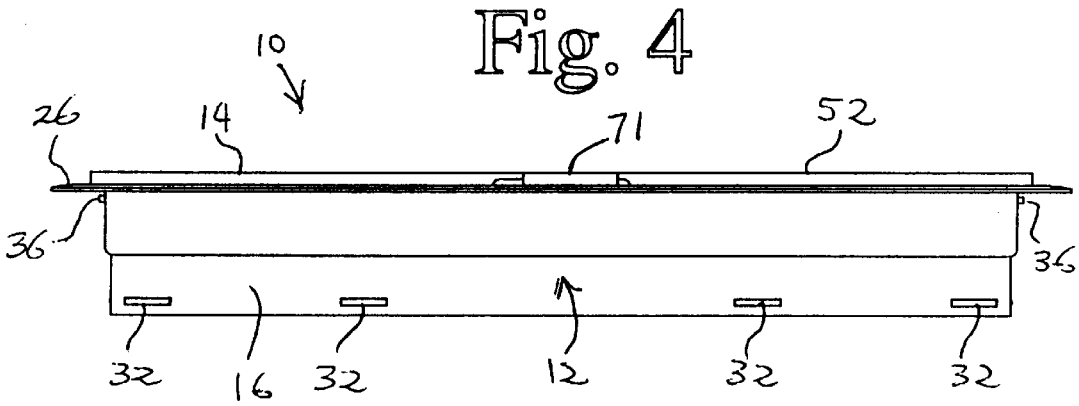
FIG. 4 is a front elevational view of the vent device of FIG. 1.
Figure 5:
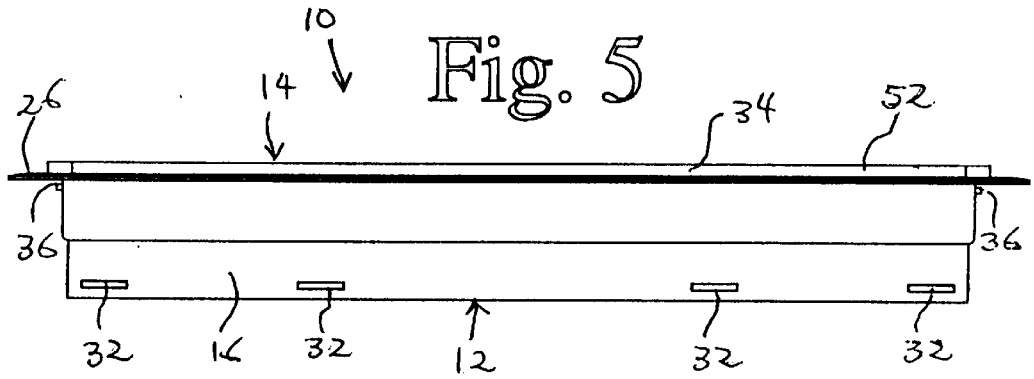
FIG. 5 is a rear elevational view of the vent device of FIG. 1.
Figure 6:
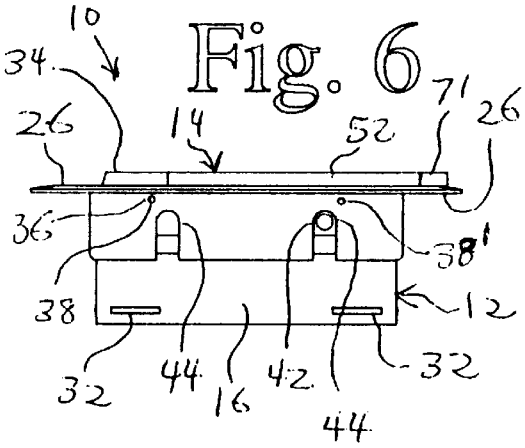
FIG. 6 is a left side elevational view of the vent device of FIG. 1.
Figure 7:
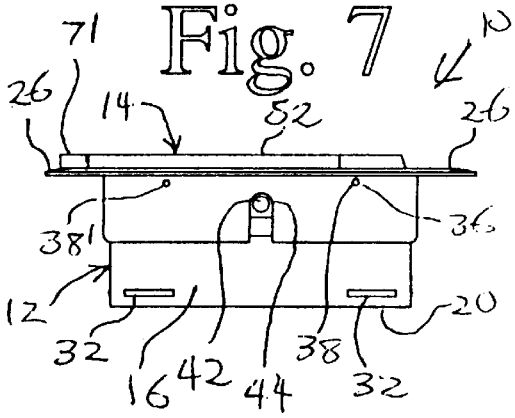
FIG. 7 is a right side elevational view of the vent device of FIG. 1.

Turning now to the drawings in greater detail and considering FIGS. 1–14, there is illustrated an embodiment, generally indicated 10, of a vent device within which features of the present invention are incorporated. The vent device 10 is designed for use with an air supply, or air-delivery, system such as, for example, the air handling system of a central heat and air conditioning unit of a building to condition the air being conducted into a room of the building. More specifically, the vent device 10 is adapted to be mounted in the floor, wall or ceiling of a room of the building for conditioning the air being communicated, or conducted from an air duct into the room. The conditioning of the air being conducted into the room by the air is performed by a filter (described herein) mounted within the vent device 10 so that the air being conducted into the room is relatively free of dust, pollen and other particulate desired to be removed from the air by the filter.

Although the vent device 10 is described herein as being used to filter the air being conducted into a room so that filtered air enters the room, it will be understood that other air-conditioning mediums, such as room deodorizers (or other scent-laden mediums) or breathable medicines, can be supported within a device, like that of the vent device 10, in accordance with the broader aspects of the present invention. Furthermore, although the vent device 10 described herein is intended to be used for conditioning the air entering a room, comparable vent devices can be designed and used at the outlets of air-delivery systems used for delivering air into other environments, such as the interior of an automobile or the cab of a truck, in accordance with the broader aspects of the present invention. Accordingly, the principles of the present invention can be variously applied.

With reference again to FIGS. 1–14, the vent device 10 includes a body 12 within which is housed a platen-like filter housing 14. Both the body 12 and the filter housing 14 can be fabricated from a strong durable plastic, but it will be understood that various other fabricating materials could be used, including various metallic materials.

In the embodiment 10 of FIGS. 1–14, the body 12 includes rectilinear walls 16 joined at four corners to define an air flow passageway 18 which permits the passage of air vertically through the body 12. The walls 16 also define a lowermost opening 20 which establishes fluid communication between the passageway 18 and an operatively associated duct 22 (FIG. 12), and define an uppermost opening 24 within which the filter housing 14 is accepted so that the filter housing 14 is at least partially disposed within the passageway 18.

Figure 12:
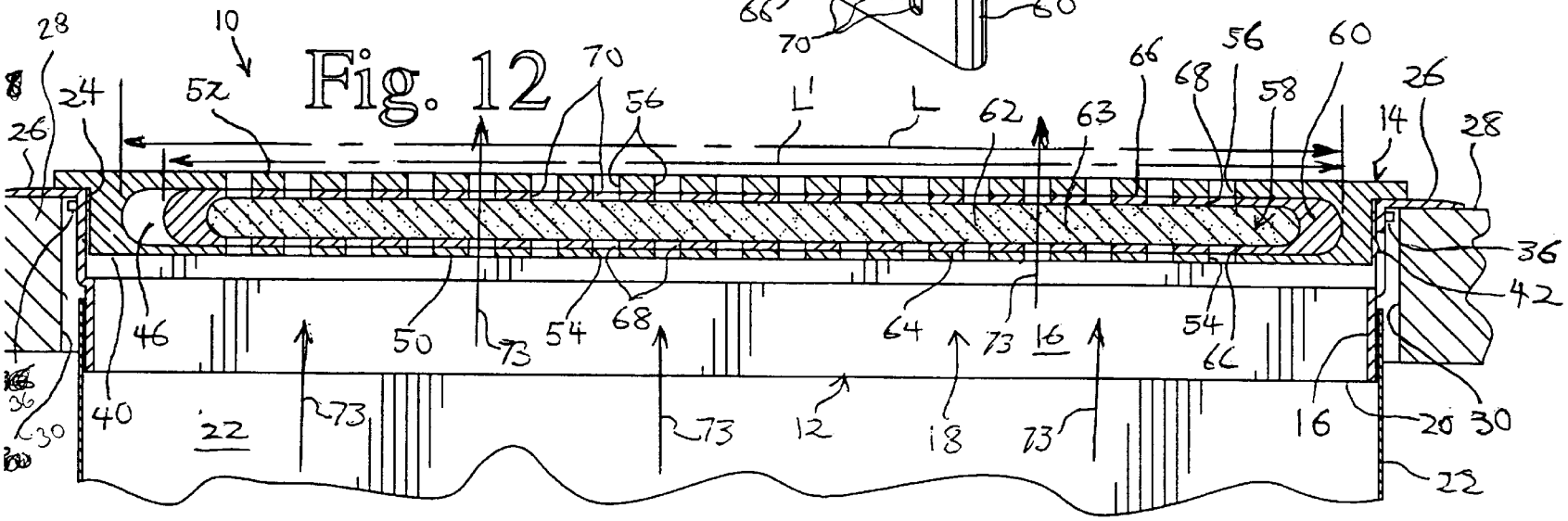
FIG. 12 is a cross-sectional view taken about along line 12—12 of FIG. 1 and illustrating the vent device being positioned within the floor of a room and wherein the filter is positioned in one position along the length of the filter housing.

The body 12 also includes an outwardly-directed mounting flange 26 which substantially encircles the uppermost opening 24 for engaging a supporting surface 28 (see FIG. 12) such as the surface of a wall, floor or ceiling, when the vent device 10 is operatively installed within a duct 12 of the wall, floor or ceiling. Therefore and as illustrated in FIG. 12, in a typical installation, at least a portion of the body 12 is accepted by an opening 30 in the duct 22 of a wall, floor or ceiling, and at least a portion of the walls 16 engages the duct 22 so that the opening 20 is in fluid communication with the air passageway of the duct 22. Furthermore, the mounting flange 26 is positioned in engagement with the supporting surface 28 of the wall, floor or ceiling so as to stabilize the body 12 when positioned therein. Preferably, the walls 16 of the body 12 are sized to accommodate force-fit insertion into the duct 22. To facilitate this force-fit engagement, protruding detent members 32 can be provided on, or formed along, the exterior of the walls 16.

In the illustrated embodiment of the vent device 10, the filter housing 14 is closely received and pivotally secured in the passageway 18 so as to serve as a closure for the passageway 18. In this connection, the filter housing 14 is pivotally secured to the body 12 proximate a rearward edge portion 34. Within the depicted vent device 10, this pivotal mounting of the filter housing 14 is accomplished with a pair of oppositely-disposed pivot pins 36 which extend from the filter housing 14 and which are received in openings 38 provided in the body 12. It will be noted that alternative openings 38' can be provided (see FIGS. 6–9) for receiving the pins 36 so that the direction in which the filter housing 14 pivots open can be reversed if desired.

Figure 8:
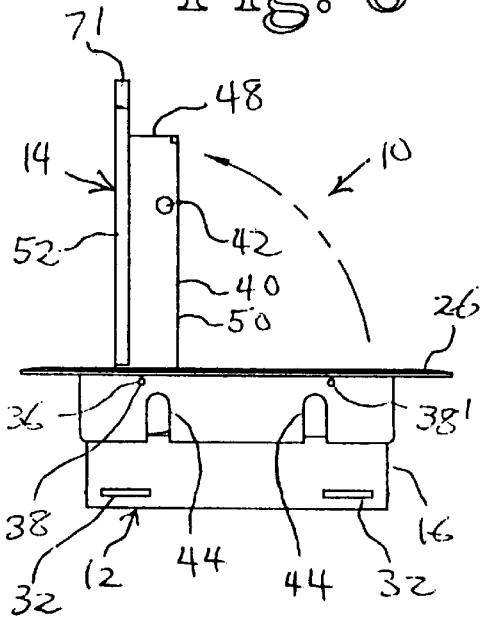
FIG. 8 is a left side elevational view of the vent device of FIG. 1 wherein the filter housing thereof has been pivoted outwardly.
Figure 9:
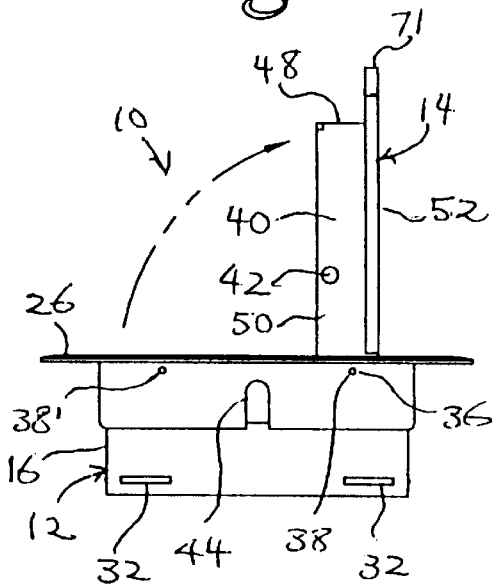
FIG. 9 is a right side elevational view of the vent device of FIG. 1 wherein the filter housing thereof has been pivoted outwardly.
Figure 10:
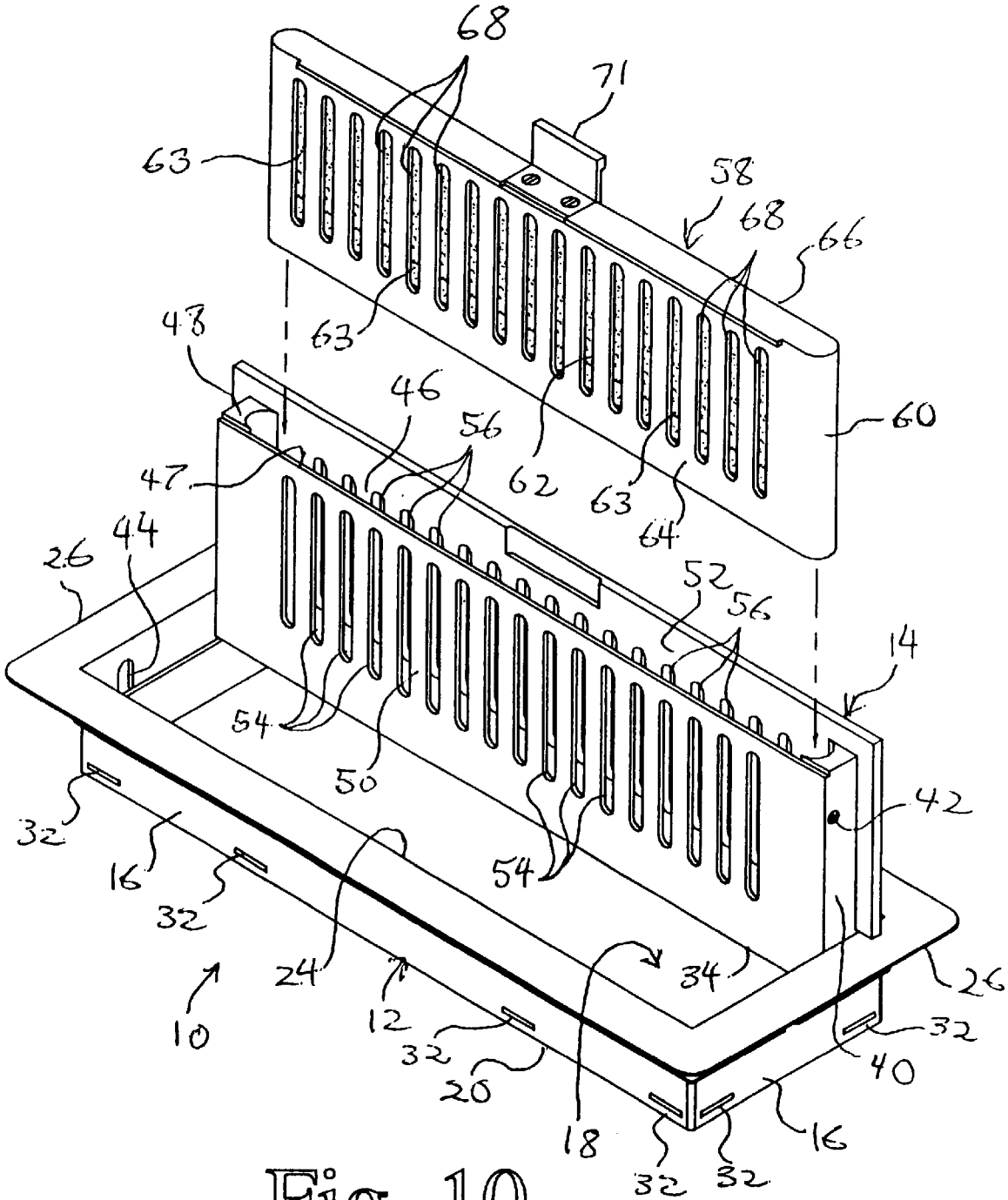
FIG. 10 is a perspective view of the vent device of FIG. 1, shown with its filter housing being pivoted outwardly and with its filter being removed from the filter housing.

It follows, therefore, that the filter housing 14 is pivotally connected to the body 12 to accommodate a pivotal movement of the housing 14 from a closed condition, as illustrated in FIGS. 1–7 at which the plane of the housing 14 is oriented substantially horizontally (and the upper surface of the housing 14 is substantially flush with the mounting flange 26), and an open condition, as illustrated in FIGS. 8–10 at which the plane of the housing 14 is disposed substantially vertically (and the upper surface of the housing 14 is positioned substantially vertically). As will be apparent herein, by positioning the filter housing 14 in its open (FIGS. 8–10) condition facilitates the removal or installation of a filter therein.

Within the depicted vent device 10, at least the inner portion 40 of the filter housing 14 is designed to be moved into a snap fit relationship within the passageway 18 when moved to its closed condition so that the filter housing 14 is less likely to inadvertently pivot to an open position. Such a snap fit relationship can be had by providing the body 12 with protruding detent members 42 (FIGS. 6 and 7) which snap into corresponding openings 44 provided in the walls 16 of the body 12 when the filter housing 14 is moved to its closed position within the passageway 18. However, it will be recognized by those skilled in the art that other mechanisms can be used to releasably secure the filter housing 14 in its closed position within the passageway 18.

As best illustrated in FIG. 10, the filter housing 14 includes means defining a filter slot 46 having an elongated slot opening 47 opening out of a forward edge portion 48 of the housing 14 and so that the housing 14 defines inner and outer walls 50 and 52, respectively. The inner wall 50 of the housing 14 is provided with a plurality of vent openings 54 which allow air to be communicated from the duct 22 into the filter slot 46, and the outer wall 52 defines a plurality of vent openings 56 whose openings are in registry with the vent openings 54 of the inner wall 50, and which allow air to be communicated from the filter slot 46 into a room of a building. Accordingly, the vent openings 54 and 56 provide communication of the air from the duct 22 (FIG. 12) through the filter housing 14 and into a room of a building.

Figure 11:
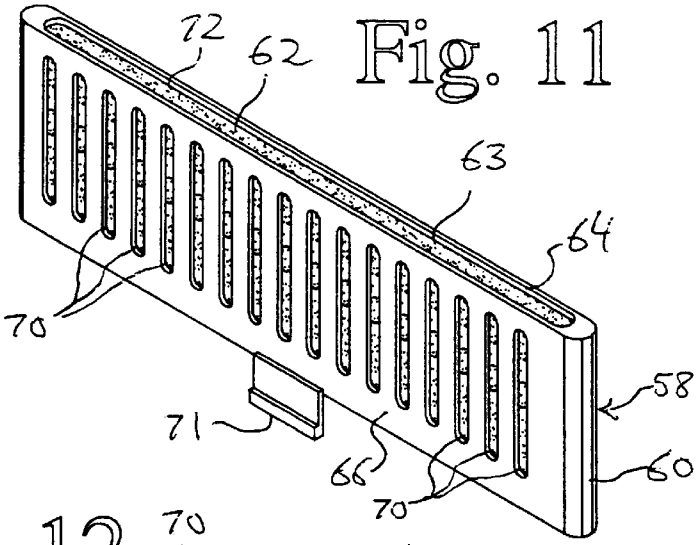
FIG. 11 is a perspective view of the filter illustrated in FIG. 10.

For purposes of filtering the air which is being introduced into the room through the duct 22, a filter 58 is removably received by the filter slot 46 of the filter housing 14. In the depicted embodiment 10 and as best shown in FIGS. 10 and 11, the filter 58 includes means providing an enclosure 60 which, in turn, defines a cavity 62 for supporting a filter medium, or material 63. The filter material 63 of the depicted filter 58 is adapted to trap unwanted dust, pollen and other particulate matter desired to be prevented from entering the room of the building by way of the vent 10. In the alternative (or in addition), a scented substance, such as an air deodorizer or freshener can be positioned within the cavity 62 to scent or deodorize the air passing through the vent device 10. Moreover, medication adapted to be absorbed by or evaporate within the air moving through the vent 10 can be positioned within the cavity 62 so that it is dispersed into a room of the building.

In connection with the foregoing, the enclosure 60 of the filter 58 includes inner and outer walls 64 and 66, respectively, disposed on opposite sides of the filter material 63. The inner wall 64 is provided with a plurality of vent openings 68, and the outer wall 66 is provided with a plurality of vent openings 70 which are in registry with the vent openings 68 to permit air flow through the filter 58. The vent openings 68 and 70 of the depicted filter 58 are configured and spaced from one another so that when the filter 58 is positioned within the housing 14, the openings 68 and 70 can be aligned (i.e. positioned in registry with) the vent openings 54 and 56.

Along the lines of the foregoing, in the depicted vent device 10, the length L (FIG. 12) of the filter slot 46 is greater than the length L' of the filter 58 (see FIG. 12) to accommodate a longitudinal shifting of the filter 58 within the slot 46. This permitted shifting allows the filter 58 to be slidably moved between a position at which the vent openings 68 and 70 are aligned with the vent openings 54 and 56 and a position at which the vent openings 68 and 70 are out of alignment with the vent openings 54 and 56 and the inner and outer walls 64 and 66 of the filter 58 totally obstruct air flow between the vent openings 54 and 56.

For example and as seen in FIG. 12 (at which the filter housing 14 is positioned in a closed position), the filter 58 has been positioned along the length of the filter housing 14 so that the vent openings 68 and 70 of the filter 58 are aligned with the vent openings 54 and 56 of the filter housing 14. When the filter 58 is positioned in this FIG. 12 position, air from the duct 22 is permitted to flow into the room through the filter 58, the direction of the air flow being indicated by the arrows 73.

Figure 13:
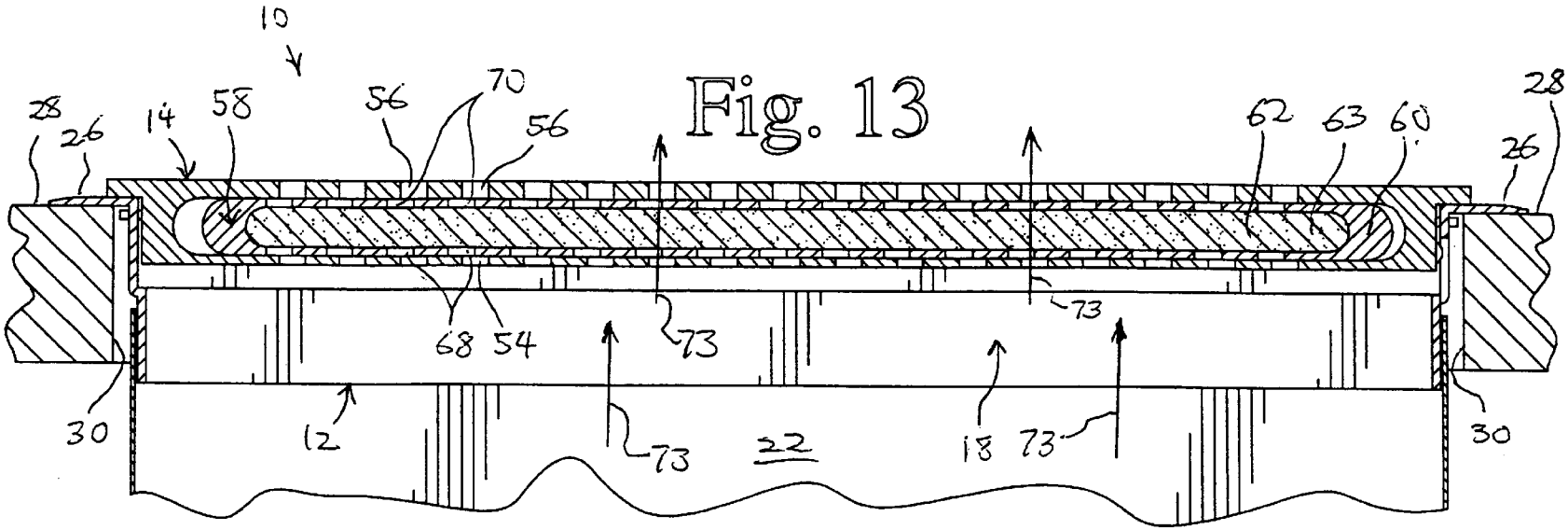
FIG. 13 is a view, similar to that of FIG. 12, wherein the filter is positioned in another position along the length of the filter housing.
Figure 14:
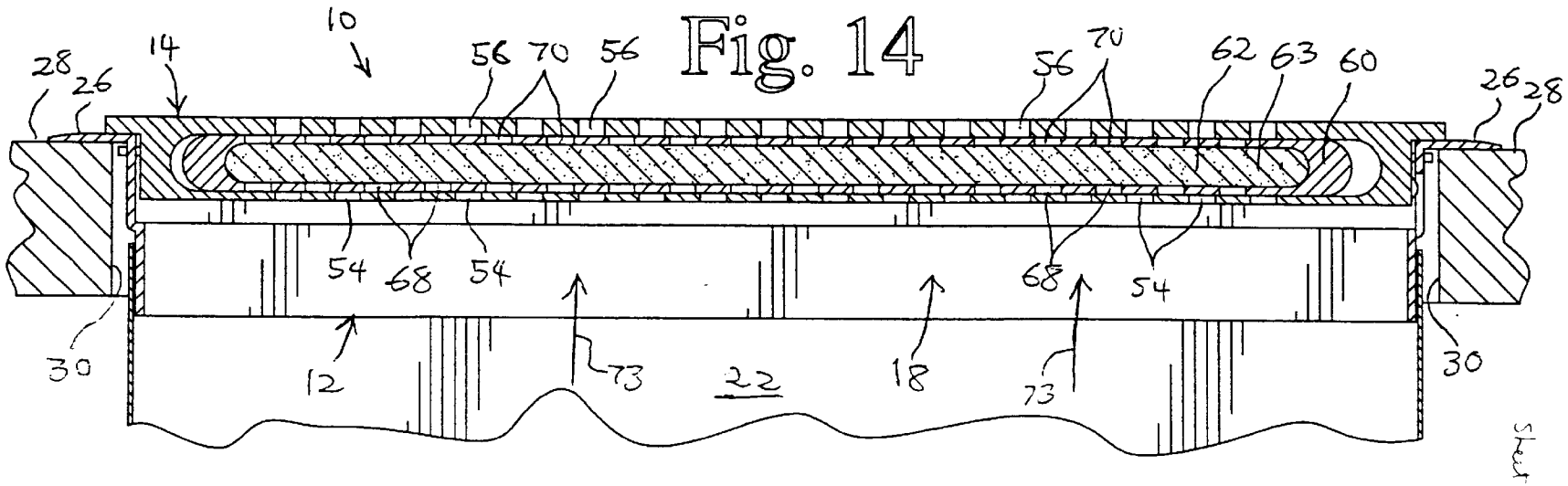
FIG. 14 is a view, similar to that of FIGS. 12 and 13, wherein the filter is positioned in still another position along the length of the filter housing.
Figure 15:
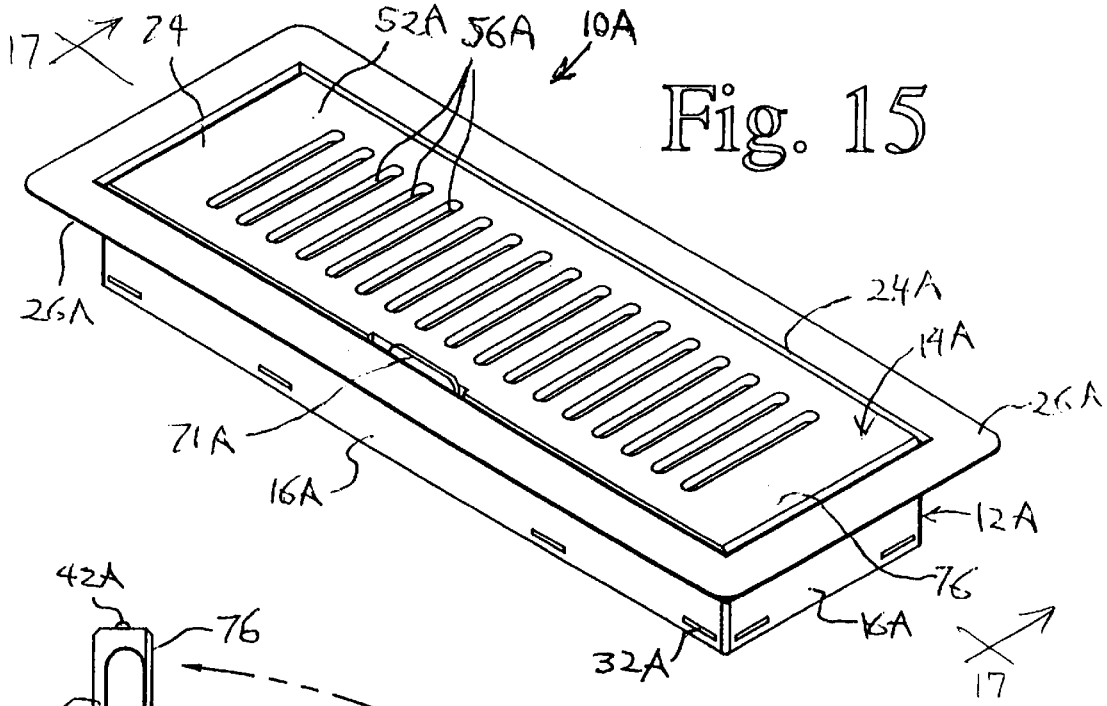
FIG. 15 is a perspective view of a first alternative embodiment of a vent device within which features of the present invention are incorporated.

On the other hand and as shown in FIG. 13, the filter 58 is positioned along the length of the housing 14 so that the vent openings 68 and 70 of the filter 58 are partially (rather than totally) aligned with the vent openings 54 and 56 of the filter housing 14. Consequently, air flow into the room through the filter 58 is partially obstructed. Further still and as shown in FIG. 14, the filter 58 is positioned along the length of the housing 14 so that the vent openings 68 and 70 of the filter 58 are wholly out of alignment with the vent openings 54 and 56 of the filter housing 14 and, in fact, are covered by the enclosure walls 64 and 66. Consequently, air flow into the room through the filter 58 is totally obstructed or shut off. Thus, the air flow through the vent device 10 into the room can be controlled by adjusting the longitudinal position of the filter 58 along the length of the filter slot 46.

To facilitate the adjustment of the position of the filter 58 along the filter slot 46, the filter 58 is provided with an actuator 71 (FIGS. 10 and 11) which is accessible when the filter housing 14 is seated within the body opening 24 (as shown in FIG. 1). Therefore, by sliding the actuator 71 to one of a number of possible positions along the length of the filter slot 46, the air flow through the vent device 10 can be controlled without pivoting the filter housing 14 relative to the body 12 and out of its normal operating position. It will also be noted that in the depicted filter embodiment 58, the filter enclosure 60 is provided with an access opening 72 (FIG. 11) opposite the side of the actuator 71 which permits the interior of the enclosure cavity 62 to be accessed. This opening 72 permits the filter material 63 to be periodically replaced, as necessary, so that the filter enclosure 60 can be reused. This filter-replacement feature notwithstanding, it is contemplated that the entire filter 58 can be disposable, thus obviating the need for the access opening 72.

Figure 16:
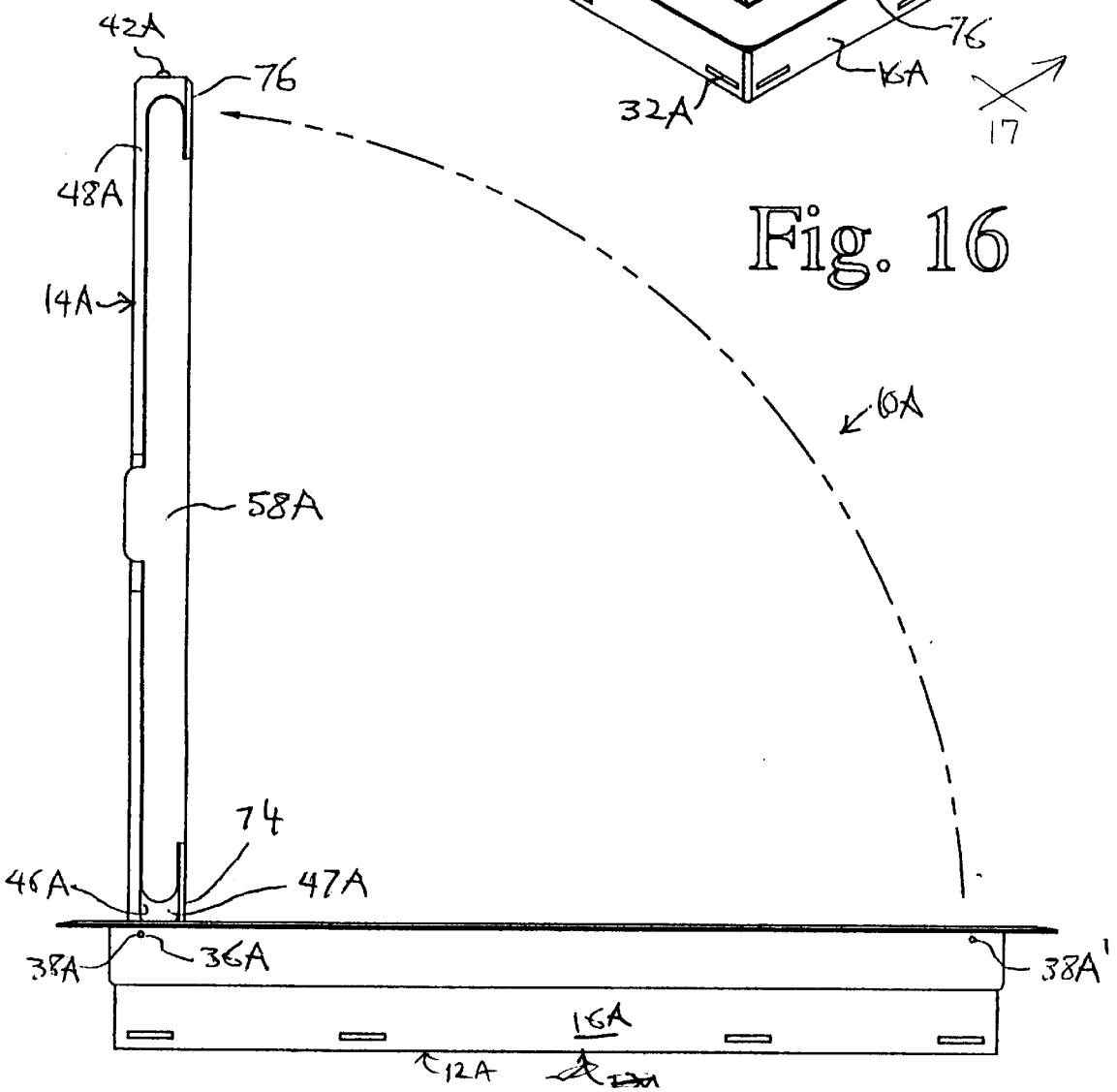
FIG. 16 is a front elevational view of the vent device of FIG. 15 wherein the filter housing thereof is shown positioned to an opened, or outward, position at which the filter housing can be accessed.
Figure 17:
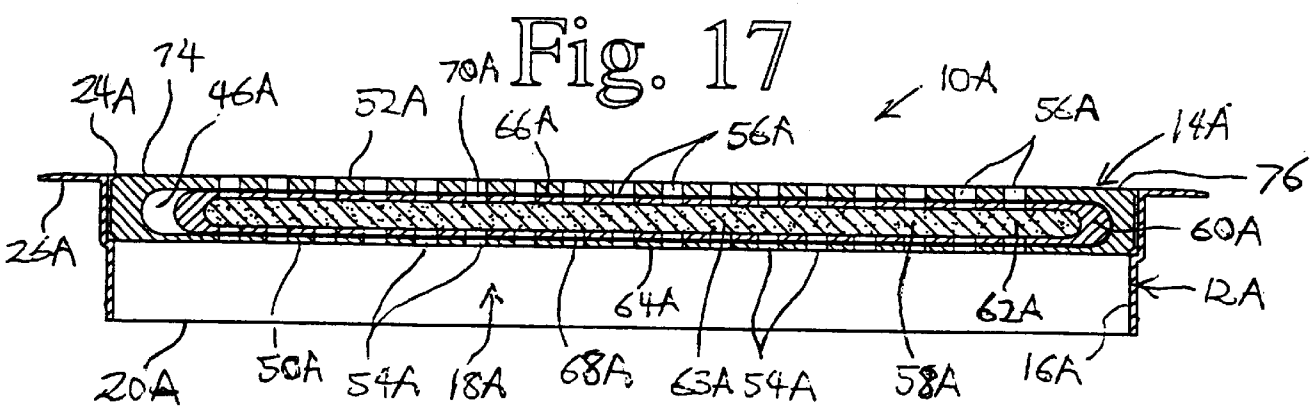
FIG. 17 is a cross sectional view of the vent device of FIG. 15 taken about along line 17—17 of FIG. 15.
Figure 19:
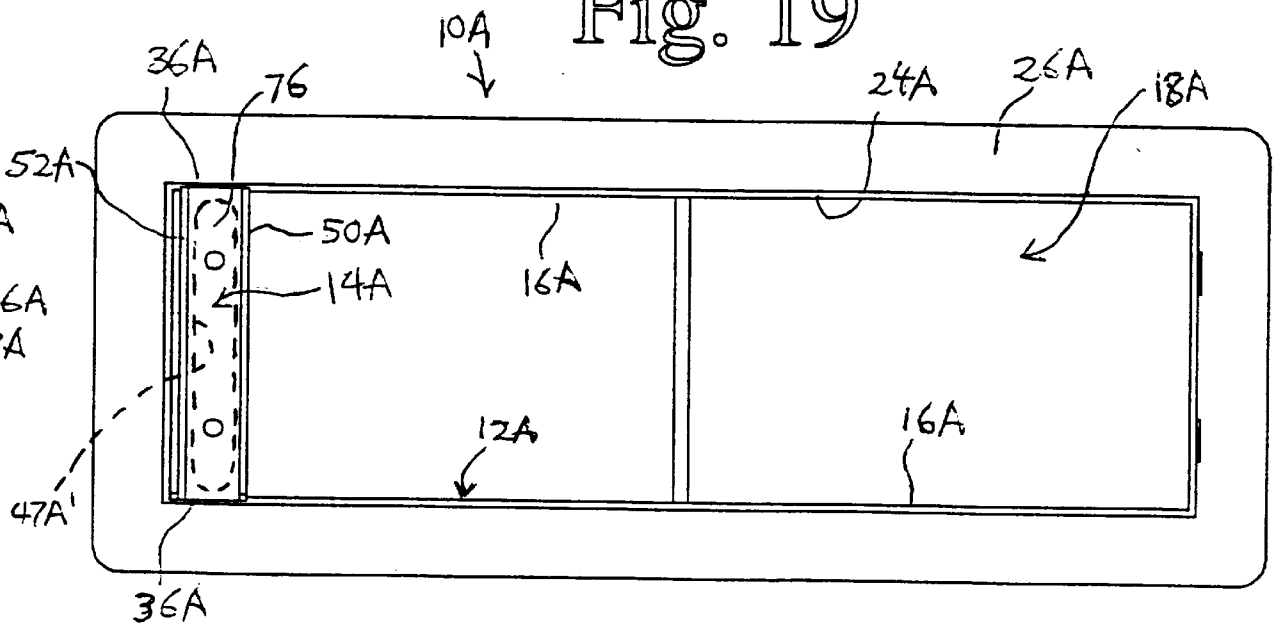
FIG. 19 is a top plan view of the vent device of FIG. 15.
Figure 18:
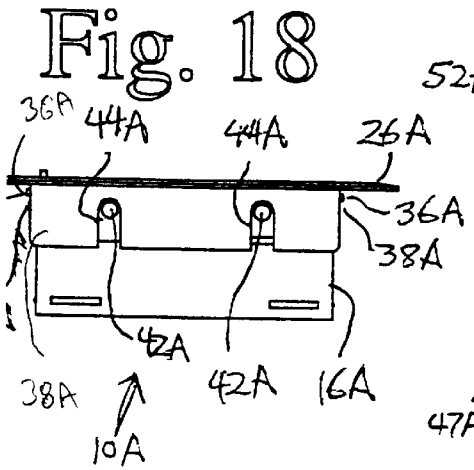
FIG. 18 is a right side elevational view of the vent device of FIG. 15.

With reference to FIGS. 15–19, there is illustrated an alternative embodiment, generally indicated 10A, embodying features of the present invention. Components of the vent device 10A which are identical to those of the vent device 10 of FIGS. 1–10 and 12–14 bear the identical reference numerals followed by the alphabetic character "A". As best illustrated in FIG. 16, the filter housing 14A of the vent device 10A pivotally engages the body 12A proximate a first end portion 74 (rather than proximate the rearward edge portion 34) so that access to the filter 58A is provided by pivoting the second end portion 76 relative to the body 10A outwardly. Further, alternative openings 38A' can be provided for pivotally receiving the pins 36A so that the direction in which the filter housing 14A pivots can be reversed if desired. Further still and as an alternative to accessing the filter housing 14A from the first end portion 74, the filter slot which receives the filter 58A can be provided in the second end portion 76 of the filter housing 14 as illustrated by the broken lines at 47A' in FIG. 19.

Figure 20:
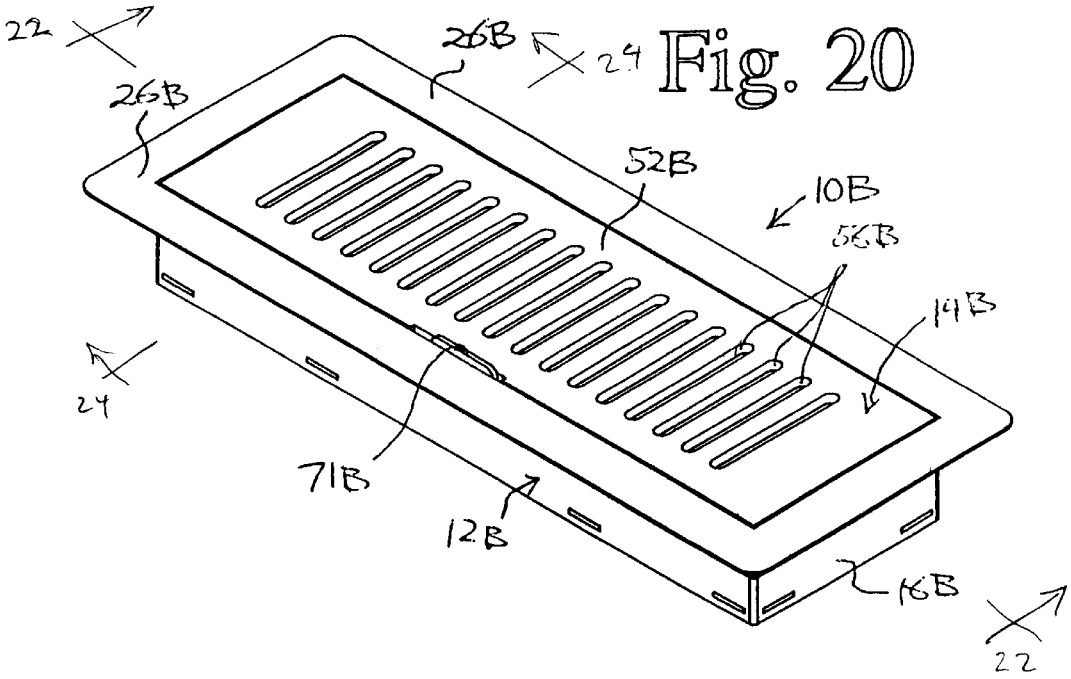
FIG. 20 is a perspective view of a second alternative embodiment of a vent device within which features of the present invention are embodied.
Figure 21:
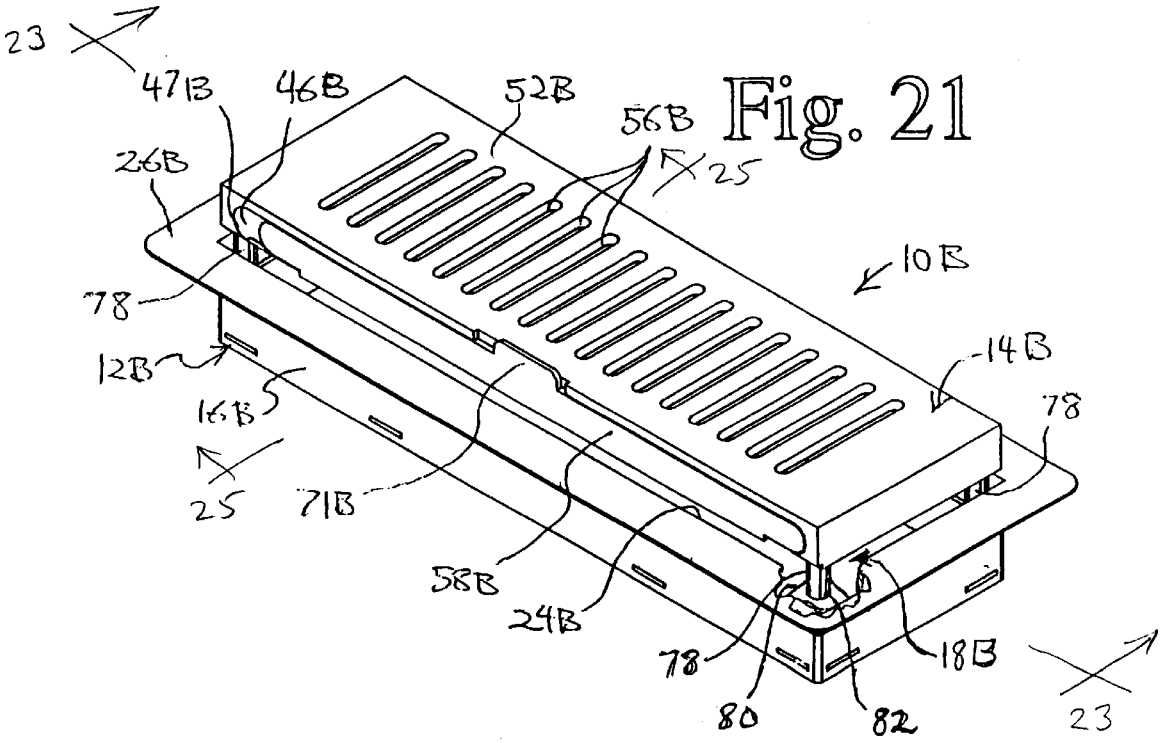
FIG. 21 is a view similar to that of FIG. 20 wherein the filter housing is shown positioned in an open position at which the filter housing can be accessed.
Figure 22:
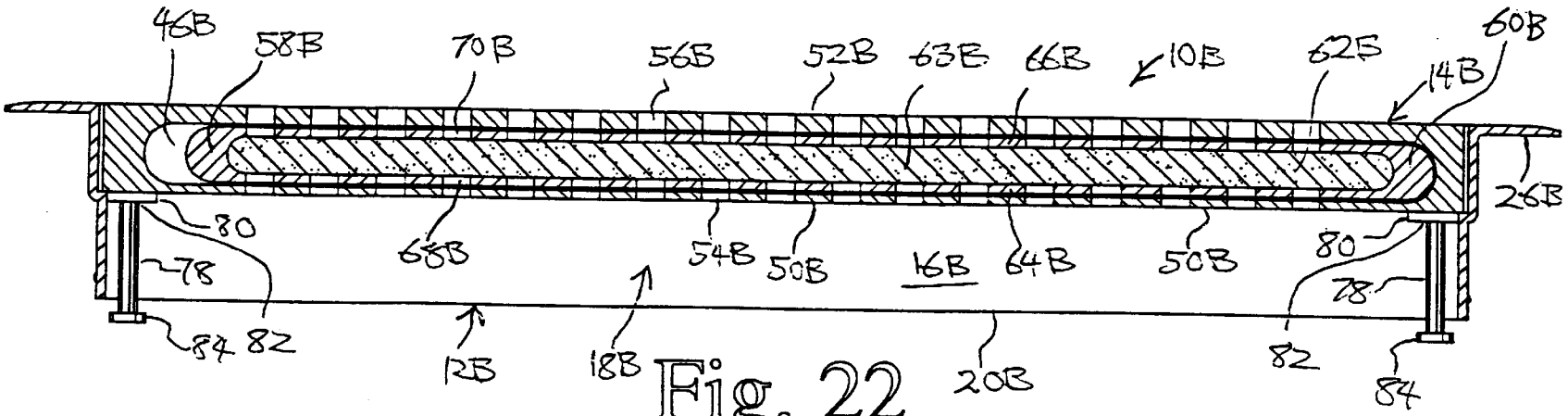
FIG. 22 is a cross sectional view of the vent device of FIG. 20, taken generally about line 22—22 of FIG. 20.
Figure 23:
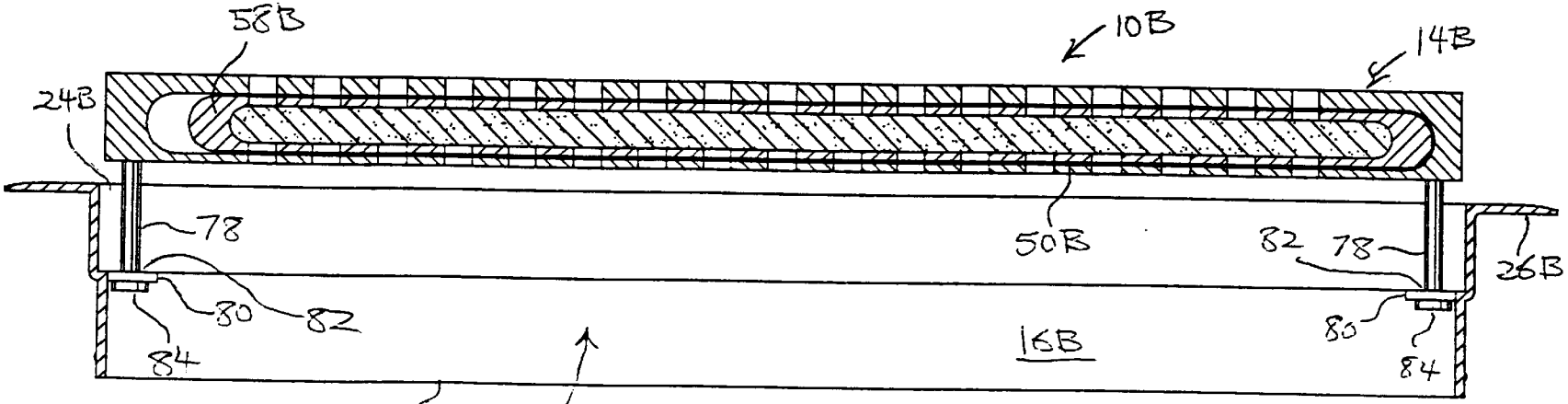
FIG. 23 is a cross sectional view of the vent device of FIG. 20, taken generally about line 23—23 of FIG. 21.
Figure 24:
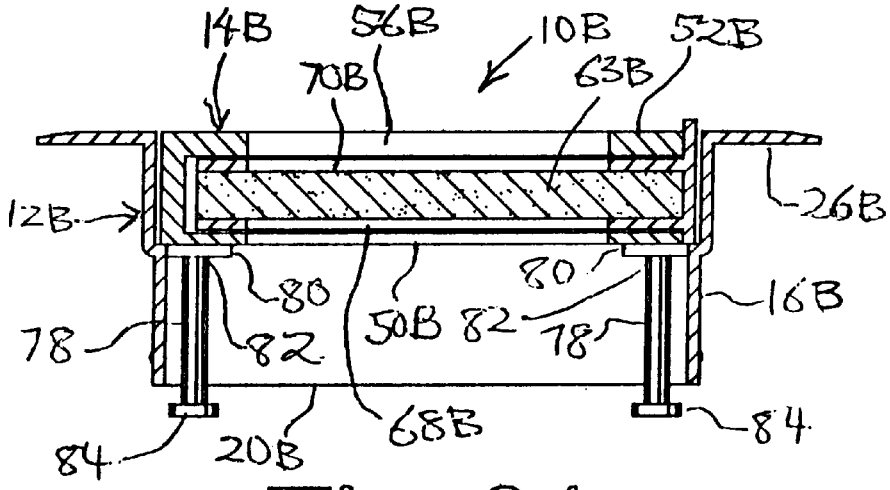
FIG. 24 is a cross sectional view of the vent device of FIG. 20, taken generally about line 24—24 of FIG. 20.
Figure 25:
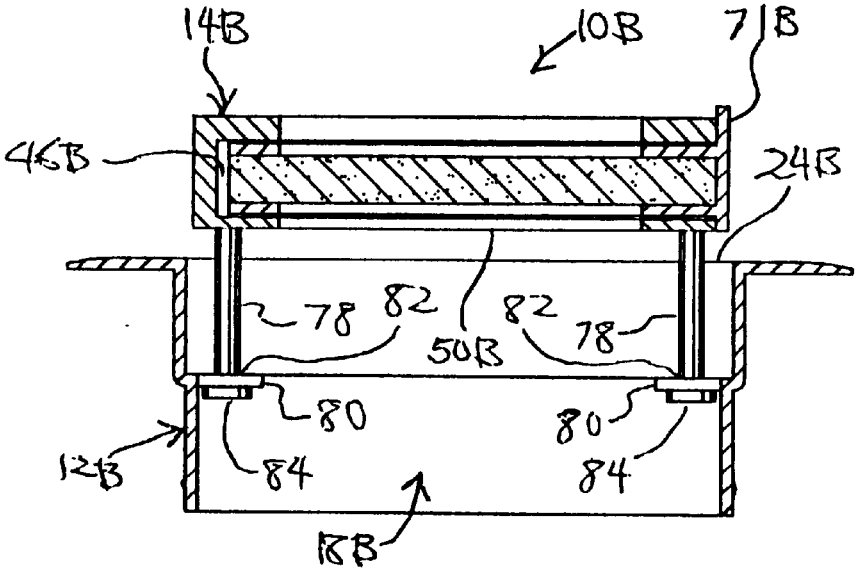
FIG. 25 is a cross sectional view of the vent device of FIG. 20, taken generally about line 25—25 of FIG. 21.
Figure 26:
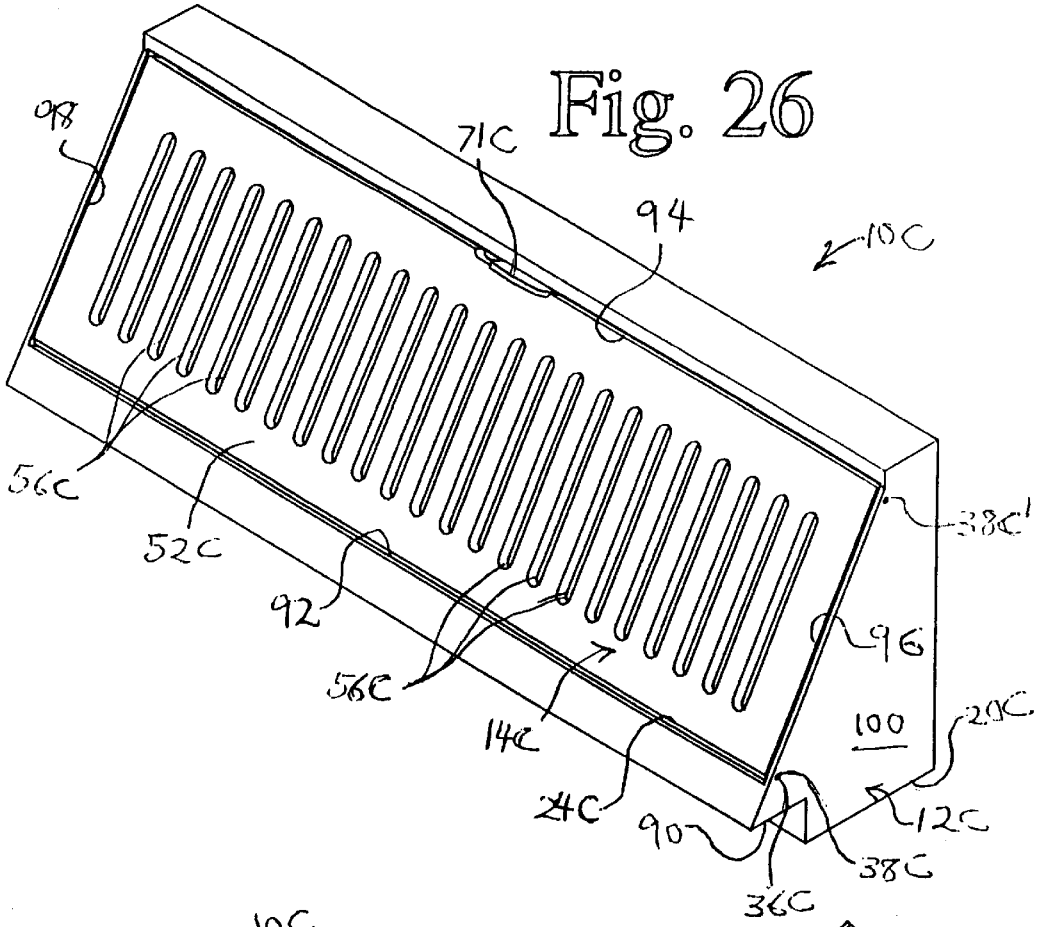
FIG. 26 is a perspective view of a third alternative embodiment of a vent device within which features of the present invention are embodied.
Figure 27:
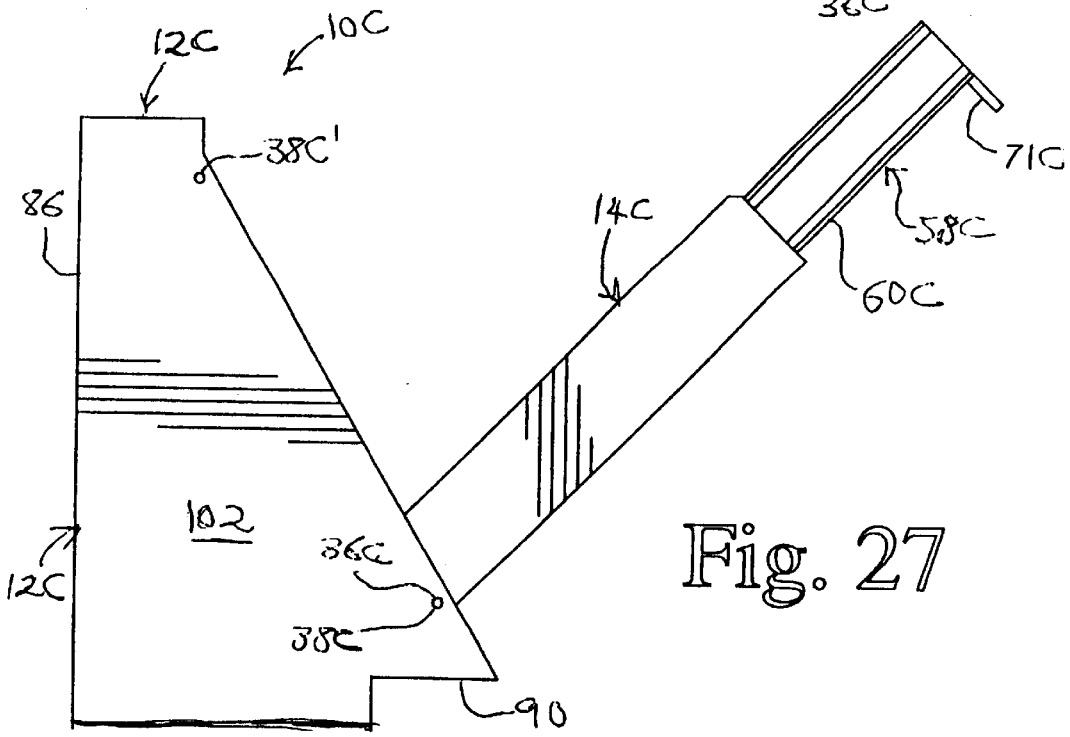
FIG. 27 is a left side elevational view of the vent device of FIG. 26 wherein the filter housing is positioned in an open position and wherein the filter is positioned partially out of the filter housing.

With reference to FIGS. 20–25, there is illustrated still another embodiment, generally indicated 10B, of a vent device embodying features of the present invention. Components of the vent device 10B which are identical to those of the vent device 10 of FIGS. 1–10 and 11–14 accordingly bear the same reference numerals followed by the alphabetic character "B". In this embodiment 10B, the filter housing 14B is connected to the body 12B to permit the passageway 18B of the body 12B to telescopes into and out of the body 12B between lower (i.e. a closed) position and an upper (FIG. 21) position at which access is provided to the filter 58B positioned within the filter housing 14B. In this regard, the filter housing 14B is provided with four mounting shafts 78 which extend outwardly from the inner wall 50B of the filter housing 14B at the four corners thereof. Moreover, the body 12B is provided with four operatively-associated mounting brackets 80, each of which is provided with a hole 82 therethrough for slidably receiving a corresponding one of the mounting shafts 78. Further, in the depicted embodiment 10B, each of the mounting shafts 78 is provided with a stop member 84 at its distal end which prohibits the distal end of the mounting shaft 78 from moving through the hole 82 in the mounting bracket 80. Accordingly, the filter housing 14B can be moved relative to the body 12B between an operative position (as illustrated in FIGS. 20, 22 and 24) wherein the filter housing 14B is positioned within the passageway 18B and an unseated position (as illustrated in FIGS. 21, 23 and 25) at which the filter 58B is accessible within the housing 14B for removal and/or replacement of the filter 58B.

Figure 28:
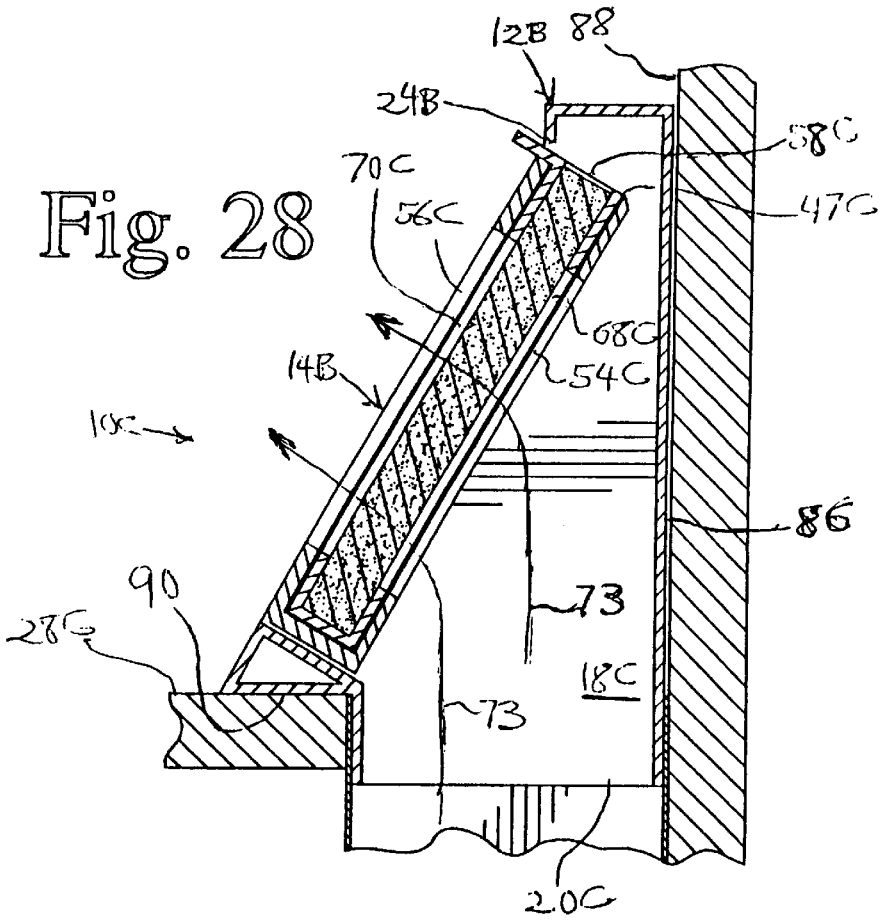
FIG. 28 is a cross sectional view of the FIG. 26 embodiment taken about along line 28—28 of FIG. 26.
Figure 29:
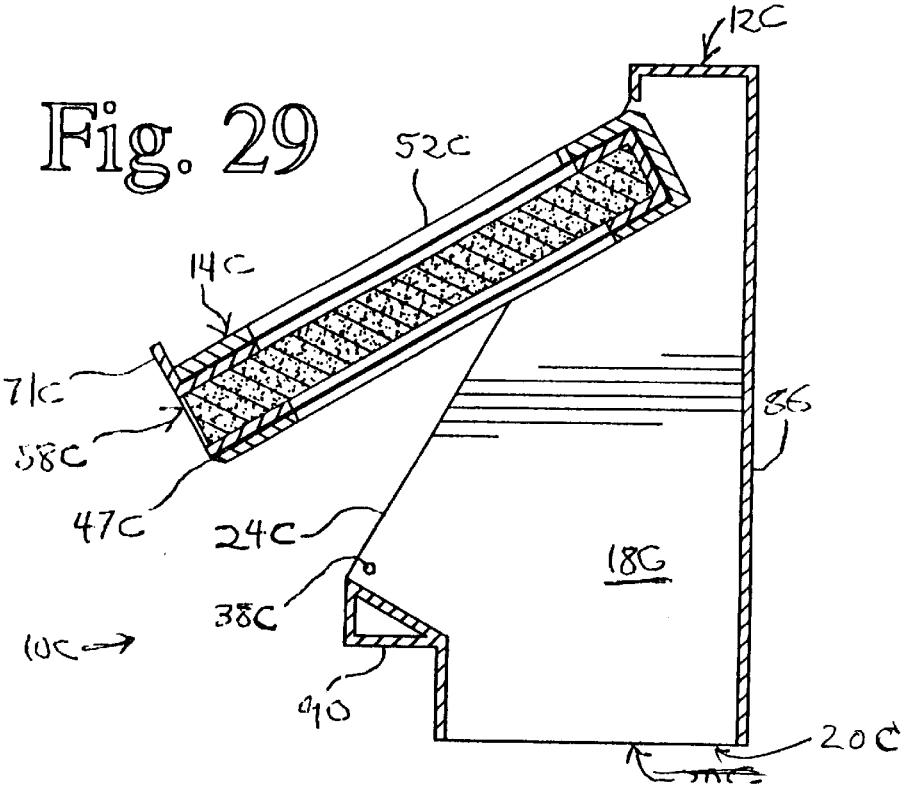
FIG. 29 is a view similar to that of FIG. 28 of still another embodiment of a vent device.
Figure 30:
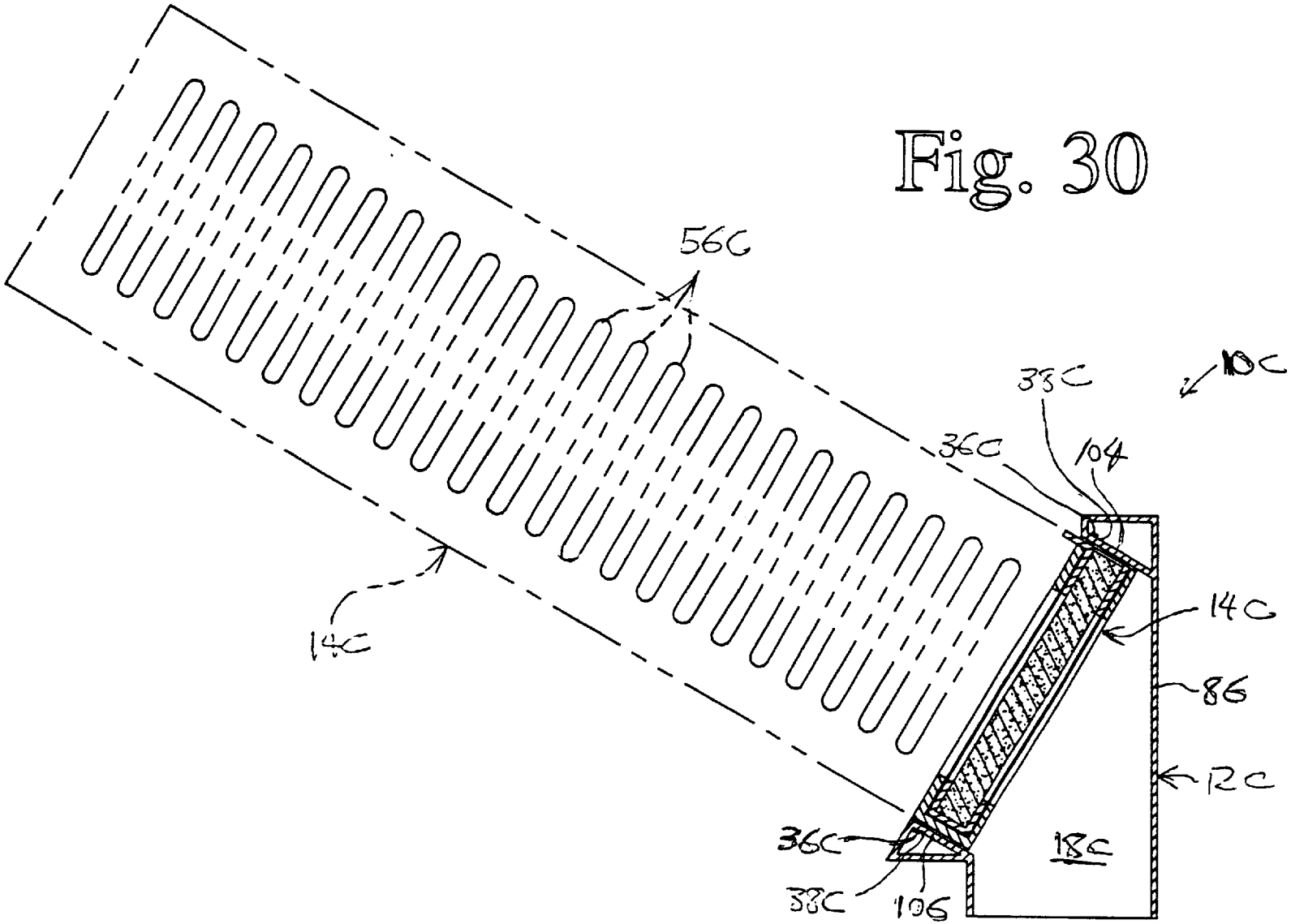
FIG. 30 is a view similar to that of FIG. 28 of yet still another embodiment of a vent device.

With reference to FIGS. 26–30, there is shown a further embodiment, generally indicated 10C, of a vent device within which features of the present invention are incorporated. Components of the vent device 10C which are identical to those of the aforedescribed vent device 10 bear the same reference numerals followed by the alphabetic character "C". The vent device 10C is designed for mounting proximate the intersection of a ceiling and wall, or proximate the intersection of a floor and a wall, of a building. As illustrated, the body 12C of the vent device 10C is configured so that a rear wall 86 is defined which, upon installation of the vent device 10c, is positioned adjacent the wall surface 88 (FIG. 28). Further, the body 12C defines a supporting wall 90 for engaging the supporting surface 28C of the floor and ceiling. In order to advantageously introduce air into the building, the opening 24C is defined in a diagonal plane relative to the rear wall 86 and the surrounding wall 90, and the filter housing 18C is mounted in the opening 24C to likewise be oriented in a diagonal plane relative to the rear wall 86 and the supporting wall 90. It will be noted that the body 12C includes first, second, third and fourth edge positions 92, 94, 96 and 98, respectively, which define the diagonally disposed opening 24C. The filter housing 14C can be pivotally mounted to the body 12C for movement about a pivotal axis oriented parallel and adjacent to any of the edge portions 92, 94, 96 or 98. For example, in FIGS. 26–28, the pivot pins 36C are received by openings 38C which are provided in the opposing sidewalls 100 and 102 of the body 12C so that the filter housing 14C pivots on an axis parallel and adjacent the first edge portion 92 of the body 12C. In FIG. 29, the pivot pins 36C have been mounted in the alternative holes 38C' so that the filter housing 14C pivots on an axis parallel and adjacent the second edge portion 94 of the body 12C. Alternatively and as illustrated in FIG. 30, the openings 38C can be provided in opposing interior walls 104 and 106 so that the filter housing 14C is permitted to pivot about an axis oriented parallel and adjacent one of the edge portions 96 or 98.

Figure 31:
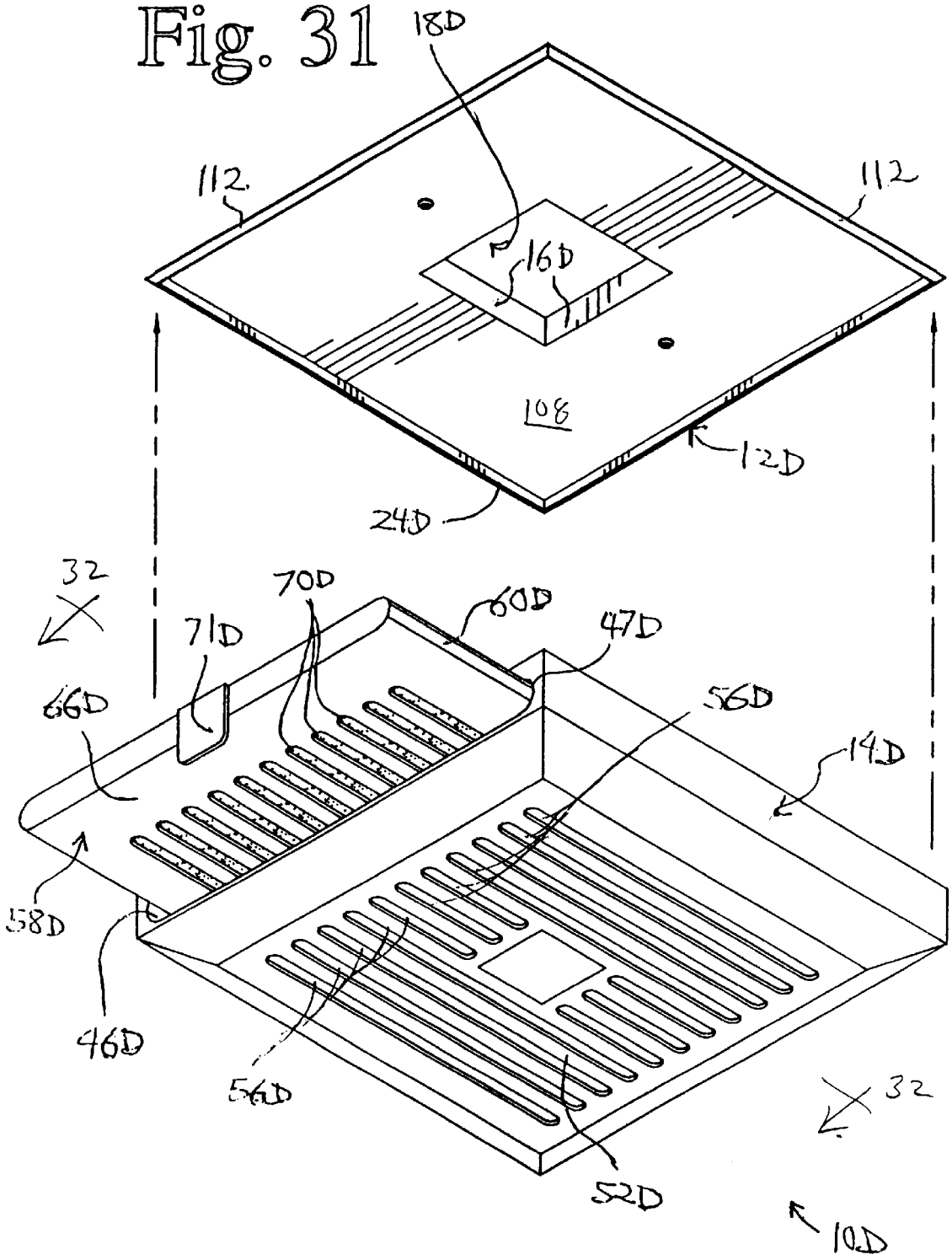
FIG. 31 is a perspective view of a sixth alternative embodiment of a vent device within which features of the present invention are embodied, shown exploded.
Figure 32:
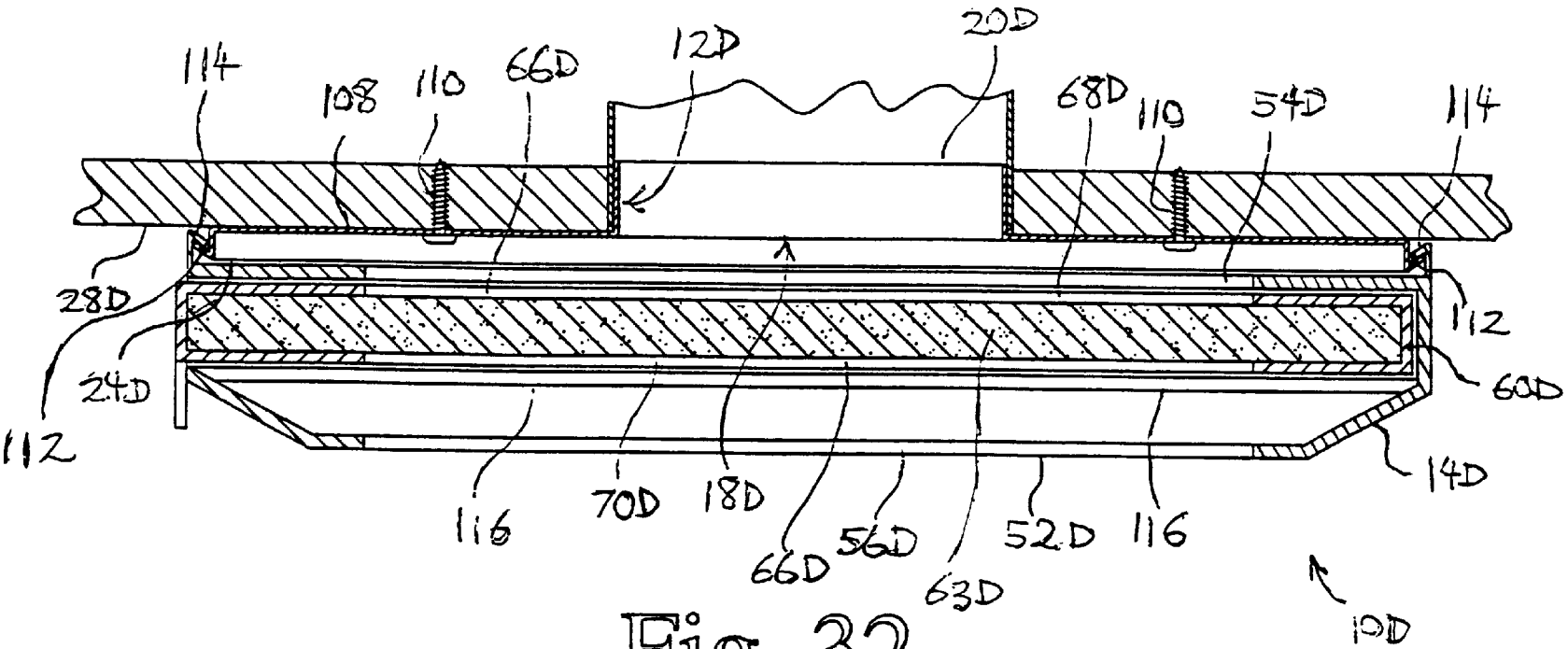
FIG. 32 is a cross sectional view of the FIG. 31 embodiment, taken generally about along line 32—32 of FIG. 31.

With reference to FIGS. 31 and 32, there is illustrated a further embodiment, generally indicated 10D, within which features of the present invention are incorporated. Components of the vent device 10D which are identical to those of the aforedescribed vent device 10 accordingly bear the same reference numerals followed by the alphabetic character "D". The vent device 10D is intended to be mounted in a ceiling or wall, and the body 12D defines a rearward wall 108 which engages the supporting surface 28D of the ceiling or wall. In this regard, the rearward wall 108 can be secured to the supporting surface with suitable mechanical fasteners such as with screws 110.

Rather than being secured in the passageway 18D as is the case with the above-described embodiments 10, 10A, 10B and 10C, the filter housing 14D of the vent device 10D is secured over the opening 24D so as to establish fluid communication between the passageway 18D and the filter housing 14D. More specifically, the body 12D of the depicted embodiment 12D defines an angular lip 112 disposed proximate the perimeter of the opening 24D, and the filter housing 14D defines an interlocking lip portion 114 which engages and interlocks with the angular lip 112 of the body 12D to secure the filter housing 14D to the body 12D. It will also be noted that the outer wall 52D of the filter housing 14D is spaced from the outer wall 66D of the filter 58D as the filter 58D is seated in the filter housing 14D. In order to support the filter 58D in its desired position, the filter housing 14D is provided with at least one, and preferably a plurality of, supporting ribs 116 which extend across the interior of the filter housing 14D (FIG. 32). The supporting ribs 116 are preferably disposed between adjacent openings 56D so as not to disrupt the flow of air moving through the housing 14D. As with the aforedescribed vent devices, the filter 58D of the vent device 10D is releasably received by the filter slot 46D and is slidable along the length of the slot 46D between alterative positions to adjust the volume of air communicated through the filter housing 14D.

It follows from the foregoing that a vent device has been described for use with a removable filter which, when used together, provide significant advantages over the prior art. The vent device allows air flow into a room to be easily controlled and allows the air entering an environment, such as a room, to be conditioned (e.g. filtered) to remove dust, pollen and/or other particulate. Furthermore and if desired, scented materials can be incorporated into a filter positioned within the vent device to deodorize a room and/or medication can be positioned within a filter for dispersal into a room by way of the vent device.

Figure 33:
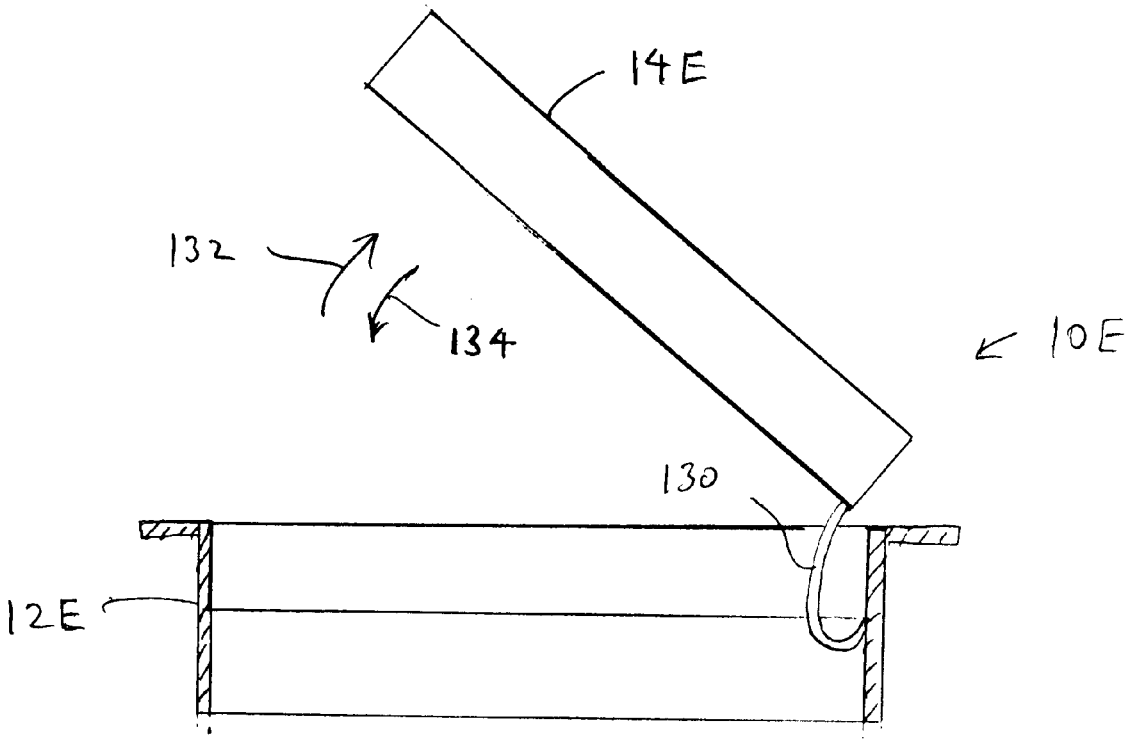
FIG. 33 is a transverse cross-sectional view of one more embodiment of the vent device within which features of the present invention are embodied.

However, while a preferred embodiment has been shown and described, it will be understood that numerous modifications and substitutions can be had to the aforedescribed embodiments without departing from the spirit of the invention. For example, although several of the aforedescribed embodiments have been shown and described as including pivot pins for pivotally connecting a filter housing to a body of the device, the housing and body can be connected to one another by means of a strap (commonly referred to in the art as a living hinge) which joins the filter housing to the body. For example, there is shown in FIG. 33 a cross section of a filter embodiment 10E having a body 12E and a filter housing 14E which are pivotally connected to one another by way of a strap 130 which joins the housing 14E to the body 12E and which permits the housing 14E to be pivotally moved relative to the body 12E (in either of the directions indicated by the arrows 132 and 134) between a closed and open conditions. If the filter housing and body are formed as a single piece unit molded, for example, out of a suitable plastic, the strap 130 can be integrally formed with the housing and body. Accordingly, the aforedescribed embodiments are intended for the purpose of illustration and not as limitation.

What is claimed is:

1. A vent device for communicating air from an air supply system into an environment, the vent device comprising:

a body having a passageway through which air is permitted to flow from an air supply system and into an environment, and the passageway including an opening;

a housing having a cavity within which a condition-altering medium is positionable and having vent openings which permit the flow of air through the cavity so that a condition-altering medium positioned within the cavity can alter a condition of the air which flows through the cavity, and the housing is attached to the body for movement relative thereto between a closed condition at which the housing is positioned within the opening of the passageway of the body so that air which flows through the passageway from the air supply system is conducted through the cavity of the housing means and an open condition at which access is provided to the cavity of the housing for removal of a condition-altering medium contained in the cavity or for placement of a condition-altering medium into the cavity; and a mechanism joined between the housing and the body which permits the housing to be moved relative to the body between a closed position at which the housing is positioned wholly within the opening of the passageway of the body and an open position at which the housing is spaced from the opening of the body to provide access to the cavity of the housing and wherein said mechanism includes a plurality of mounting shafts joined to the housing so as to extend therefrom, and the body includes a mounting bracket associated with each mounting shaft, and each mounting bracket defines a hole therethrough for slidably receiving a corresponding one of the mounting shafts so that as the housing is moved between its closed and open conditions, the mounting brackets are slidably moved along the length of the mounting shafts.

2. The vent device as defined in claim 1 wherein the housing includes means providing a slot through which the cavity is accessible, and the cavity is adapted to support a condition-altering medium inserted therein through the slot, and the cavity-providing means includes sidewalls on opposite sides of the cavity wherein each sidewall includes a plurality of vent openings which permit the flow of air through the cavity so that when a condition-altering medium is positioned within the cavity, air which is permitted to flow through the sidewalls by way of the vent openings is exposed to the condition-altering medium.

3. The vent device as defined in claim 1 wherein the housing is attached to the body to permit pivotal movement of the housing relative to the body between the closed condition and the open condition.

4. The vent device as defined in claim 3 wherein the housing is pivotally attached to the body by way of a strap joined between the body and the housing.

5. In combination with a condition-altering medium for altering the condition of air entering an environment from an air supply system, a vent device for communicating air from the air supply system into the environment, the vent device comprising:

a body having a passageway through which air is permitted to flow from an air supply system and into the environment, and the passageway including an opening, and a housing having a cavity within which the condition-altering medium is positionable and having vent openings which permit the flow of air through the cavity so that when the condition-altering medium is positioned within the cavity and air flows therethrough, the condition of air flowing out of the is altered, and the housing is attached to the body for move relative thereto between a closed condition at which the housing positioned within the opening of the passageway of the body so that air which flows through the passageway from the air supply system is conducted through the cavity of the housing means and an open condition at which access is provided to the cavity of the housing for removal of the condition-altering medium contained in the cavity or for placement of the condition-altering medium into the cavity; and a mechanism joined between the housing and the body which permits the housing to be moved relative to the body between a closed position at which the housing is positioned wholly within the opening of the passageway of the body and an open position at which the housing is spaced from the opening of the body to provide access to the cavity of the housing; and wherein said mechanism of the vent device which is joined between the housing and the body includes a plurality of mounting shafts joined to the housing so as to extend therefrom, and the body includes a mounting bracket associated with each mounting shaft, and each mounting bracket defines a hole therethrough for slidably receiving a corresponding one of the mounting shafts so that as the housing is moved between its closed and open conditions, the mounting brackets are slidably moved along the length of the mounting shafts.

6. The combination as defined in claim 5 wherein the housing of the vent device includes means providing a slot through which the cavity is accessible, and the cavity is adapted to support a condition-altering medium inserted therein through the slot, and the cavity-providing means includes sidewalls on opposite sides of the cavity wherein each sidewall includes a plurality of vent openings which permit the flow of air through the cavity so that when a condition-altering medium is positioned within the cavity, air which is permitted to flow through the sidewalls by way of the vent openings is exposed to the condition-altering medium.

7. The combination as defined in claim 5 wherein the housing of the vent device is attached to the body thereof to permit pivotal movement of the housing relative to the body between the closed condition and the open condition.

8. The combination as defined in claim 7 wherein the housing of the vent device is pivotally attached to the body thereof by way of a strap joined between the body and the housing.

9. In combination with a condition-altering medium for altering the condition of air entering an environment from an air supply system, a vent device for communicating air from the air supply system into the environment, the vent device comprising:

a body having a passageway through which air is permitted to flow from an air supply system and into the environment, and the passageway including an opening; and a housing having a cavity within which the condition-altering medium is positionable and having vent openings which permit the flow of air through the cavity so that when the condition-altering medium is positioned within the cavity and air flows therethrough, the condition of air flowing out of the cavity is altered, and the housing is attached to the body for movement relative thereto between a closed condition at which the housing is positioned within the opening of the passageway of the body so that air which flows through the passageway from the air supply system is conducted through the cavity of the housing means and an open condition at which access is provided to the cavity of the housing for removal of the condition-altering medium contained within the cavity or for placement of the condition-altering medium into the cavity; and wherein the condition-altering medium is a filter positionable within the cavity of the housing and the filter has a plurality of through-openings therein and is movable within the cavity between one position at which the through-openings of the filter are positioned in registry with the vent openings of the housing so that air is permitted to flow through the housing and another position at which the through-openings of the filter are positioned out of registry with the vent openings of the housing so that air flow through the housing is prevented.

10. The combination as defined in claim 9 wherein the filter carries a room deodorizer or a medicine.

11. The combination as defined in claim 9 wherein the filter is positionable in any of a number of positions relative to the housing between said one position and said another position so that by moving the filter between two of such positions, the air flow through the housing can be controlled.

12. A vent device for communicating air from an air supply system into a room of a building, said vent device comprising:

a body having a passageway therethrough for receiving air from the air supply system, said body defining a first opening placing said passageway in fluid communication with said air supply system and defines a second opening accessing said passageway of said body;

a filter housing defining a filter slot and having an inner wall provided with a plurality of first vent openings selectively placed in fluid communication with said passageway of said body so as to communicate air supplied by said air supply system from said passageway to said filter slot, said filter housing having an outer wall provided with a plurality of second vent openings communicating with said filter slot and the room in the building so as to communicate air from said filter slot into the room; and a filter from being removably received in said filter slot of said filter housing, said filter defining a filter enclosure defining a cavity housing a filter material, and defining inner and outer walls, said inner wall being provided with a plurality of third vent openings and said outer wall being provided with a plurality of fourth vent openings which register with said third vent openings to provide air flow through said filter, said second and third vent openings being configured and spaced so that they can be selectively aligned to register with said first and second vent openings of said filter housing when said filter is selectively positioned in said filter slot, and so that the vent openings of the filter can be selectively moved out of alignment with said first and second vent openings of the filter housing so that said inner wall of said filter housing at least partially covers said third vent openings thereby at least limiting air flow from said passageway of said body to said cavity of said filter enclosure.

13. The vent device as defined in claim 12 wherein said filter slot defines a first length, and said filter defines a second length greater than said first length such that said filter is slidable in said filter slot between a first position wherein said third and fourth vent openings register with said first and second vent openings, and a second position wherein the flow of air through said filter is prohibited.

14. The vent device as defined in claim 12 wherein the filter housing is pivotally mounted in said body so as to be pivotally movable from a position to intercept air passing through said passageway of said body to an outwardly pivoted position wherein said filter slot of said filter housing is accessible for selectively replacing the filter in said filter slot.

15. The vent device as defined in claim 12 wherein said filter housing defines a forward edge portion in which a slot opening accessing said filter slot is defined, and defines a rearward edge portion, and wherein said filter housing is pivotally secured to said body proximate said rearward edge portion and at least an inner portion of said filter housing is pivotally received in said second opening in said body so as to intercept air passing through said passageway of said body.

16. The vent device as defined in claim 12 wherein said filter housing defines a forward edge portion in which a slot opening accessing said filter slot is defined and includes first and second end portions, and wherein said filter housing is pivotally secured to said body proximate said first end portion and at least an inner portion of said filter housing is pivotally received in said opening in said body so as to intercept air passing through said passageway of said body.

* * * * *